United States Patent [19]

Miyasaka

[11] 4,437,768

[45] Mar. 20, 1984

[54] MOVEMENT STRUCTURE FOR AN ELECTRONIC TIMEPIECE

[75] Inventor: Kenji Miyasaka, Tanashi, Japan

[73] Assignee: Citizen Watch Company Limited, Tokyo, Japan

[21] Appl. No.: 251,812

[22] Filed: Apr. 7, 1981

[30] Foreign Application Priority Data

| | | | |
|---|---|---|---|
| Apr. 11, 1980 | [JP] | Japan | 55-47565 |
| Jul. 22, 1980 | [JP] | Japan | 55-99415 |
| Jul. 22, 1980 | [JP] | Japan | 55-99417 |
| Sep. 12, 1980 | [JP] | Japan | 55-126991 |

[51] Int. Cl.[3] ..... G04C 23/02

[52] U.S. Cl. ..... 368/88

[58] Field of Search ..... 368/76, 80, 88, 155, 368/156, 159, 160, 276, 203, 204, 220

[56] References Cited

U.S. PATENT DOCUMENTS

| | | | |
|---|---|---|---|
| 2,974,474 | 3/1961 | Wegner | 368/204 |
| 3,885,381 | 5/1975 | Kasai et al. | 368/157 |
| 3,911,665 | 10/1975 | Van Berkum | 368/80 |
| 4,079,582 | 3/1978 | Tamaru et al. | 368/76 |
| 4,087,957 | 5/1978 | Miyasaka et al. | 368/204 |
| 4,228,389 | 10/1980 | Vennard | 368/88 |
| 4,277,704 | 7/1981 | Giger et al. | 368/76 |
| 4,297,838 | 11/1981 | Watanabe et al. | 368/76 |
| 4,321,521 | 3/1982 | Ueda et al. | 368/204 |

*Primary Examiner*—Vit W. Miska

*Attorney, Agent, or Firm*—Jordan & Hamburg

[57] ABSTRACT

An improved structure is disclosed for the movement of an electronic quartz crystal controlled wristwatch of very small size, suitable for use as a ladies bracelet timepiece. The configuration of this structure is such that a relatively large capacity battery can be utilized, thereby ensuring satisfactory battery life, by positioning the battery such as to substantially cover the wheel train of the timepiece and by a special arrangement of shapes and positions for other components of the timepiece.

20 Claims, 16 Drawing Figures

MOVEMENT STRUCTURE FOR AN ELECTRONIC TIMEPIECE

BACKGROUND OF THE INVENTION

In recent years, various advances have been made in the design and manufacture of electronic timepieces which utilize a quartz crystal vibrator as a frequency standard, and a very wide variety of styles and designs are now available. There is one area however in which the requirements for a special type of quartz crystal electronic timepiece have not been satisfied by modern technology to a satisfactory extent. This is in the area of electronic wristwatches of very small size, for use as a ladies wristwatch or bracelet watch. The failure to meet the special requirements for such a timepiece are not due primarily to an inability to manufacture components of very small size for use in a highly miniaturized electronic timepiece. They are, rather, due to the limitations placed upon the size of such an electronic timepiece by considerations of battery capacity and the minimum practicable battery lifetime. As the size of battery used to power such an electronic timepiece is reduced, the usable battery life is of course also reduced. This problem is increased by the fact that a stepping motor of very small size is less efficient than a motor of more normal size, thereby increasing the power consumption of the timepiece and further tending to reduce the battery lifetime. In addition, it is desirable that the movement of such a miniaturized electronic timepiece should be as thin and flat as possible, in order to provide a maximum of freedom for designing a timepiece of unusual and elegant design. However, with prior art arrangements for the various components of a timepiece, it is not possible to reduce the thickness of the timepiece movement below a certain amount.

With a movement structure according to the present invention, the problems described above which arise with prior art movement configurations are substantially reduced, enabling a movement of extremely small size to be produced which is thin and flat in shape, yet which can accommodate a relatively large size of battery, thereby ensuring a practicable battery lifetime.

SUMMARY OF THE INVENTION

The present invention relates to an improved movement structure for an electronic timepiece of analog type, i.e. equipped with time indicating hands, which is extremely flat and of very small size. The small size and thinness are achieved by adoping an arrangement of the various elements of the electronic timepiece which is basically different from that generally used in the prior art, e.g. by positioning the battery of the timepiece directly over the wheel train and the quartz crystal vibrator, and also by changing the configuration of certain elements themselves, for example by arranging the construction of the stepping motor of the timepiece such that the motor coil is stacked vertically above the stator and rotor of the stepping motor. In addition, the position of the timepiece battery, with respect to the overall shape of the movement structure, is such that a battery of relatively large size and high capacity can be utilized. This is a fundamental reason why a movement structure according to the present invention can enable a completely practicable yet highly miniaturized electronic timepiece to be produced. However in spite of the very small size, a movement structure for an electronic timepiece according to the present invention incorporates all of the necessary components of the timepiece, including a correction switch mechanism.

DESCRIPTION OF THE PREFERRED EMBODIMENTS

Figure 1:
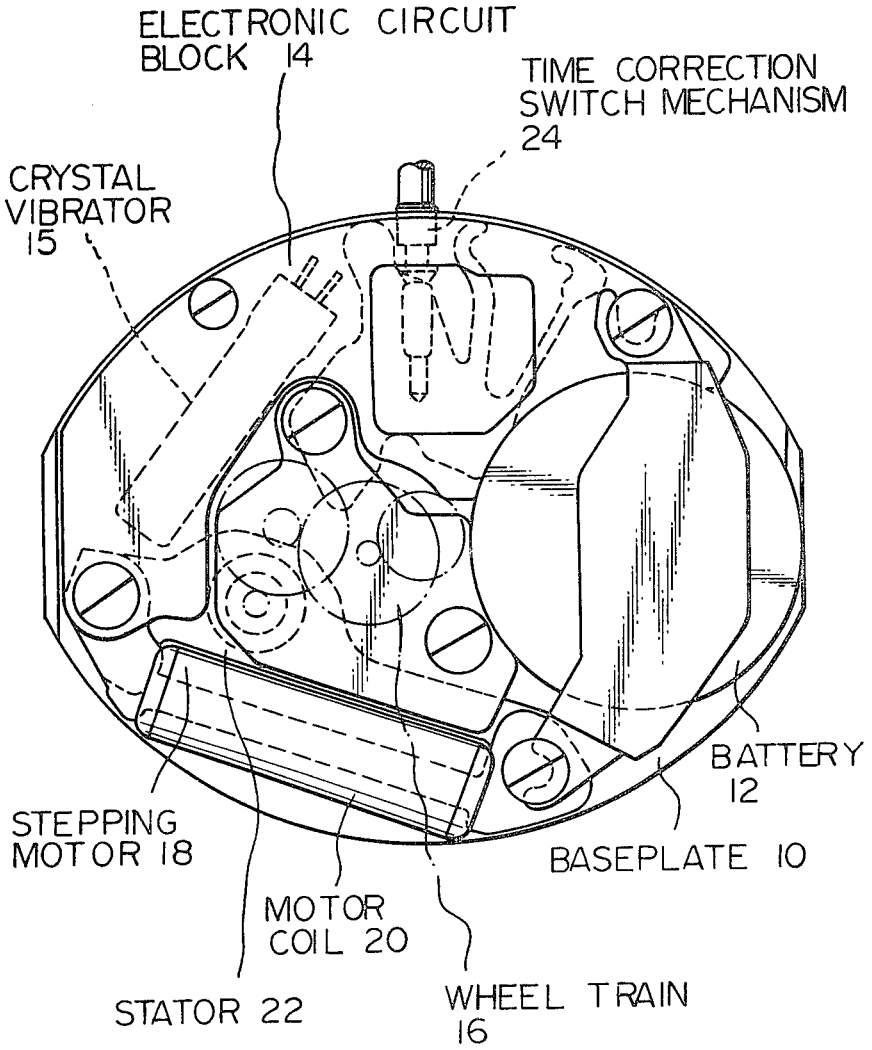
FIG. 1 is a plan view illustrating the various components of a miniature electronic timepiece according to the prior art, and the general positions of these components.

Referring to the attached drawings, FIG. 1 shows a plan view which illustrates the general arrangement of the various components of a movement structure for a quartz crystal controlled ladies bracelet watch, of analog type, with the movement structure shown being typical of the prior art. Numeral 10 denotes the baseplate of the movement structure, upon which are positioned a battery 12, an electronic circuit block 14 which includes timekeeping circuitry and a quartz crystal vibrator 15, a stepping motor 18, a wheel train 16, and a time correction switch mechanism 24. As shown, all of these elements are substantially separated from one another on baseplate 10, except for some partial overlapping of the components In addition, the stator 22 of the stepping motor 18 of the timepiece is positioned in a different area of the baseplate 10 from the coil 20 of the stepping motor.

It can be understood from FIG. 1 that, if it is attempted to produce a movement structure of reduced size, with an arrangement of components such as is shown, it would be necessary to reduce the size of both stepping motor 18 and battery 12, as well as various other components. However, a reduction in the size of battery 12 will result in a reduction of battery capacity, and hence a shortening of the operating lifetime of the battery. In addition, reduction of the size of stepping motor 18 will cause some reduction in the operating efficiency of the motor, thereby causing more power to be consumed in driving stepping motor 18, and so further tending to reduce the operating life of battery 12. It can thus be seen that a simple reduction of the sizes of the components of a miniature electronic timepiece having a movement structure of prior art type, in order to reduce the overall size of the timepiece, will not present a practicable solution.

Figure 2:
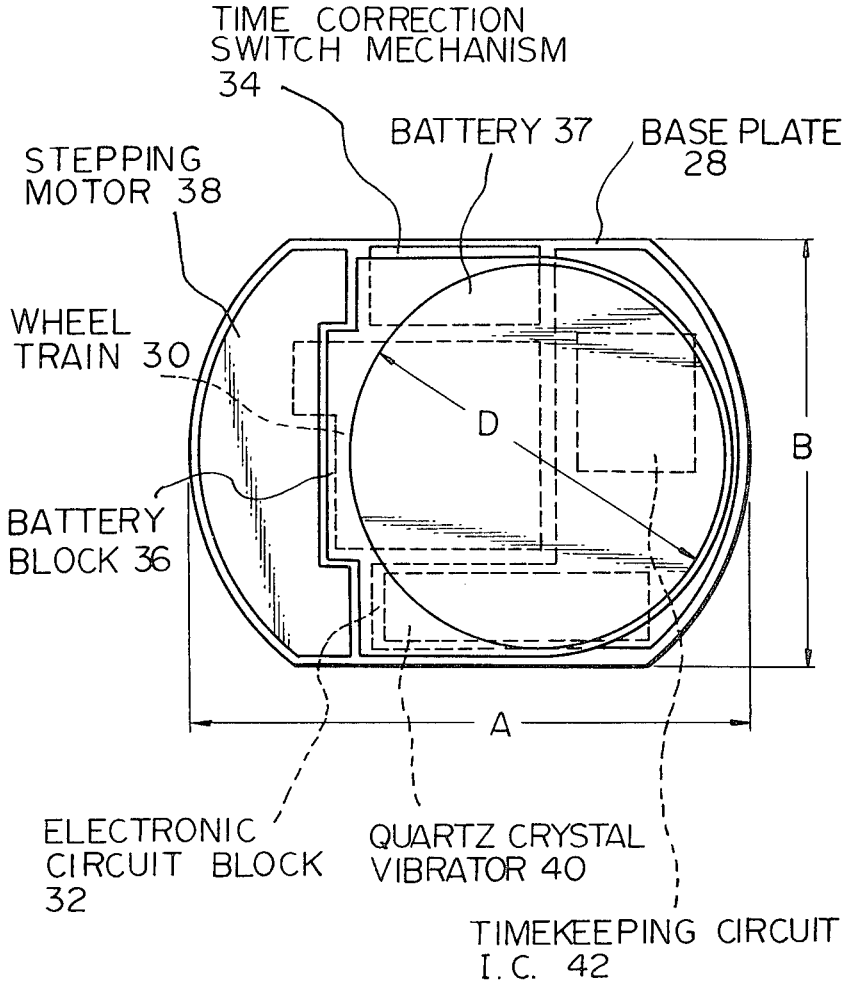
FIG. 2 is a highly simplified plan view illustrating the basic configuration of a movement structure for an electronic timepiece according to the present invention.

Referring now to FIG. 2, a plan view is shown therein for illustrating, in highly simplified form, the general configuration of a movement structure for a miniature analog type quartz crystal electronic timepiece according to the present invention. A baseplate 28 is of slightly elongated shape, and can be in the form of an elipse, a rectangle, or as shown in FIG. 2, having two parallel sides and two ends which are in the form of arcs of a circle. Such a shape, as in the case of an elipse or rectangle, is basically symmetrical about a minor axis of symmetry, referred to hereinafter as the minor axis and denoted by the letter B in FIG. 2, and about a major axis of symmetry, abbreviated hereinafter to the major axis and denoted in FIG. 2 by the letter A. A battery block 36 includes a battery 37, which is essentially disk-shaped and has a diameter denoted by the letter D. Numeral 30 denotes the wheel train of the time-piece, which is positioned within a central area of baseplate 28, with the major part of wheel train 30 being positioned below battery 37. Numeral 34 denotes a time correction switch mechanism, which is externally actuatable to produce correction signals for correcting the time information indicated by the timepiece hands. Numeral 38 denotes a stepping motor and numeral 40 denotes a quartz crystal vibrator 40 which is electrically coupled to an electronic circuit block 32. The electronic circuit block 32 includes a timekeeping circuit unit comprising an integrated circuit or integrated circuit chip, which is electrically connected to quartz crystal vibrator 40 to thereby produce timekeeping signals for periodically driving stepping motor 38, and which will be designated hereinafter as the timekeeping circuit IC 42. As shown, wheel train 30 is situated in a central area of baseplate 28, while the time correction switch mechanism 34, timekeeping circuit IC 42, quartz crystal vibrator 40, and stepping motor 38 are each positioned in areas of baseplate 28 around wheel train 30, adjacent to the periphery of baseplate 28. The longitudinal axis of quartz crystal vibrator 40 is arranged parallel to the major axis A of baseplate 28, as also is the longitudinal axis of time correction switch mechanism 34, which in a movement structure according to the present invention is of elongated shape. In addition, stepping motor 38 is accommodated at one end of baseplate 28 (the term "end" being used herein to indicate the shorter sides of baseplate 28, i.e. for the example of FIG. 2, the sides which are curved into arcs of a circle), while battery 37 is positioned towards the opposite end of the baseplate 28 from stepping motor 38. In addition to covering a major part of wheel train 30, battery 37 also substantially covers the timekeeping circuit IC 42, and the quartz crystal vibrator 40.

Figure 3:
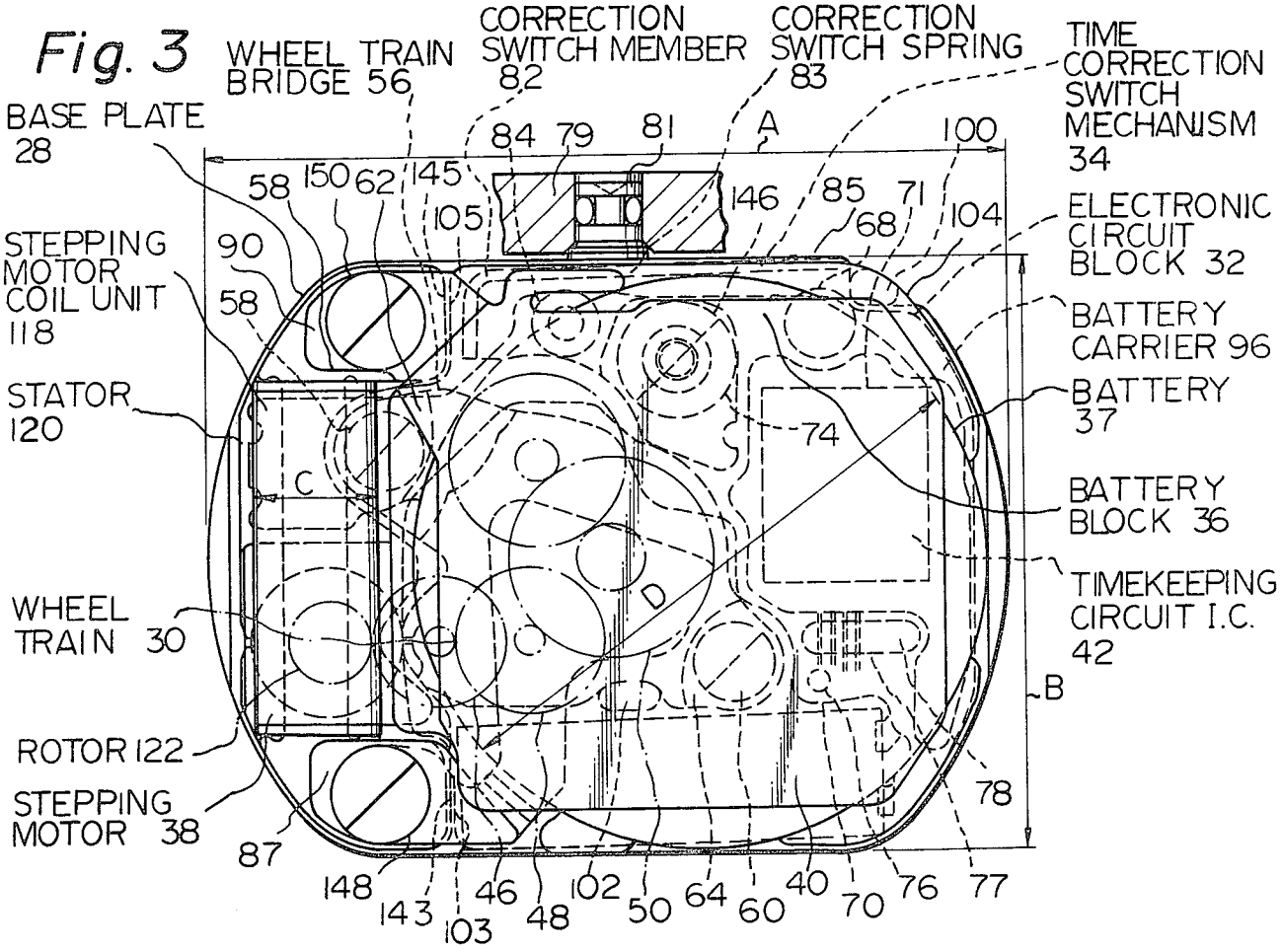
FIG. 3 is a cross-sectional view in a plan of a first embodiment of a movement structure for an electronic timepiece according to the present invention.
Figure 4:
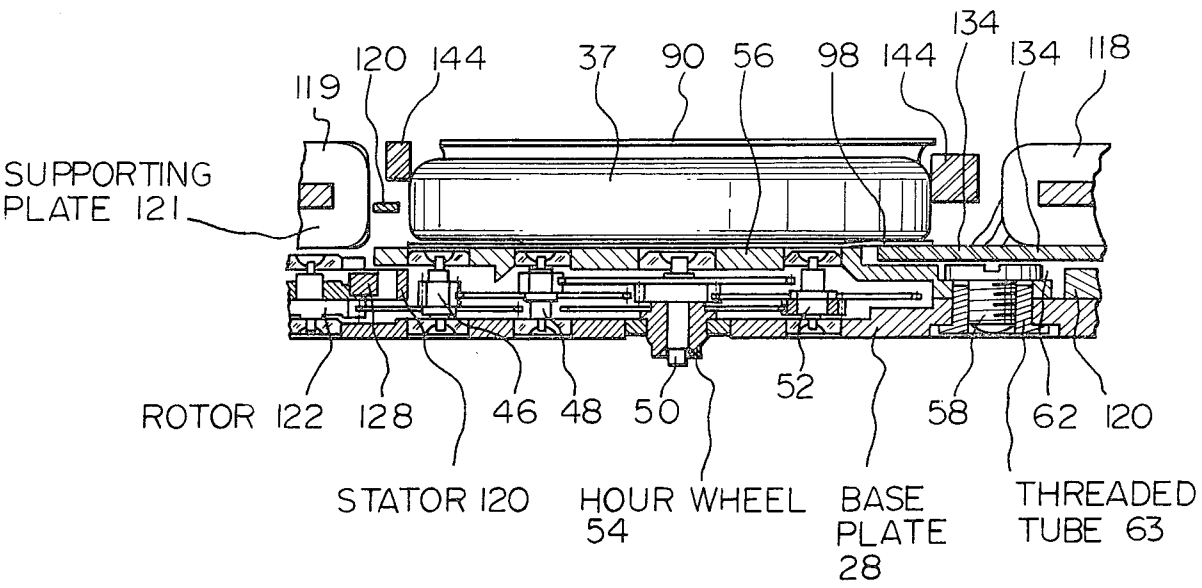
FIG. 4 is a cross-sectional view in elevation of a portion of the movement structure embodiment of FIG. 3 for illustrating the general positions of a stepping motor and the components thereof and of a battery, with respect to a baseplate of the movement structure.
Figure 5:
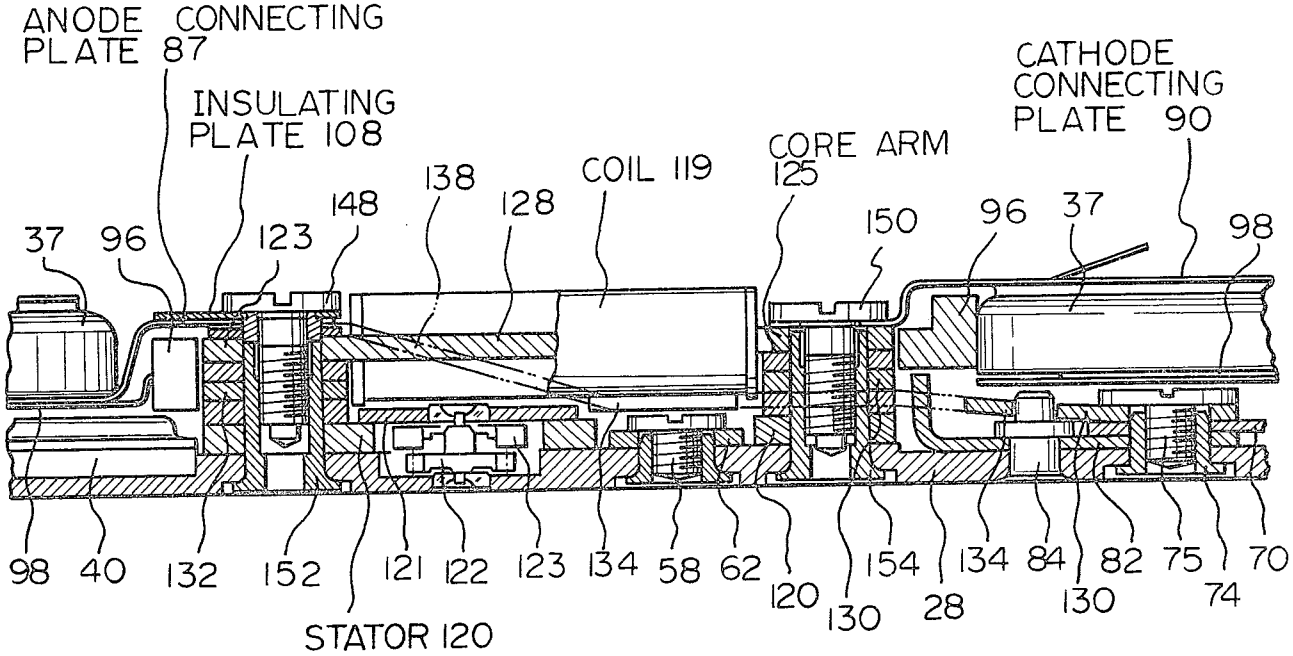
FIG. 5 and FIG. 6 are other cross-sectional views in elevation for illustrating the configuration of the movement structure according to the present invention shown in FIG. 3.
Figure 6:
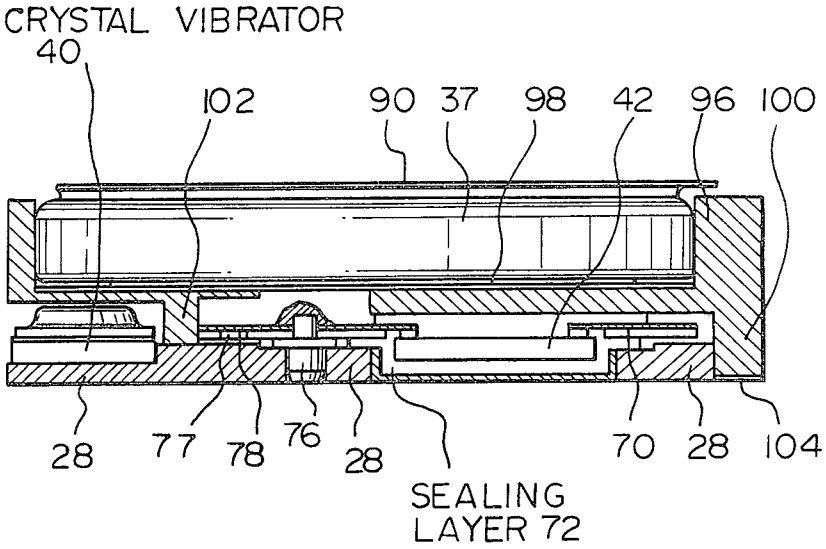

Referring now to FIG. 3, a first embodiment of a movement structure for an electronic timepiece according to the present invention is illustrated in a plan view which shows the general configuration of the components of the movement. This movement structure is basically according to the arrangement illustrated in FIG. 2 and described above. FIGS. 4, 5 and 6 are partial cross-sectional views in elevation, for assistance in understanding the configurations of a battery and stepping motor of this embodiment. As in FIG. 2, the wheel train 30 is positioned in a substantially central area of baseplate 28, and is surrounded by timekeeping circuit IC 42, situated in one end of baseplate 28, stepping motor 38 positioned at the opposite end of baseplate 28, time correction switch mechanism 34 positioned adjacent to wheel train 30 and with its longitudinal axis parallel to major axis A of baseplate 28, and quartz crystal vibrator 40 positioned on the opposite side of wheel train 30 from time correction switch mechanism 34, with its longitudinal axis also parallel to the major axis A.

Wheel train 30 comprises a second wheel 46, third wheel 48, center wheel 50, minutes wheel 52 and hours wheel 54. As illustrated in FIG. 4, wheel train 30 is accommodated within a space which is formed between a wheel train bridge 56 and the upper surface of baseplate 28. The wheel train bridge 56 is fixedly attached to baseplate 28 by means of two screws 58 and 60, each of which is screwed into a threaded tube fixedly mounted in baseplate 28, such as is denoted by numeral 74 in FIG. 4. Recessed areas 62 and 64 are formed in wheel train bridge 56, to accommodate the heads of screws 58 and 60.

Electronic circuit block 32 comprises timekeeping circuit IC 42, a circuit substrate 70 on which timekeeping circuit IC 42 is mounted as illustrated in FIG. 6, and a switch terminal 68 for time correction switch mechanism 34 also mounted on circuit substrate 70. Conductive patterns are formed on a surface of circuit substrate 70, for providing interconnections between timekeeping circuit IC 42 and switch terminal 68, quartz crystal vibrator 40, etc. In this embodiment, timekeeping circuit IC 42 comprises an integrated circuit chip which is covered by a protective coating of synthetic resin material denoted by numeral 72, as shown in FIG. 6. In this embodiment, also, quartz crystal vibrator 40 is fixedly attached to baseplate 28 and terminals of quartz crystal vibrator 40 are electrically connected by soldering to the conductive pattern on circuit substrate 70. A part of the conductive pattern on circuit substrate 70 is electrically connected to baseplate 28 by means of soldering to a pin 76 which projects upward from baseplate 28 as shown in FIG. 6. This solder connection to pin 76 also serves, together with a screw 75, to fix circuit substrate 70 in position. Screw 75 is screwed into a threaded tube 74, which is fixedly mounted in baseplate 28.

Numeral 78 denotes an aperture formed in circuit substrate 70 above which is formed a conductive pattern having a number of sections which can be selectively cut, e.g. by means of a laser beam, in order to trim the time-keeping rate of the timepiece, these sections being coupled to a standard frequency oscillator circuit of timekeeping circuit IC 42.

The time correction switch mechanism 34 comprises a correction switch member which is fixed to baseplate 28 by a screw 75, and to which is attached a correction switch spring 83. An externally actuatable movable member 81 (not a part of the movement structure itself) is located in an aperture in the timepiece case 79. When this member 81 is depressed, correction switch spring 83 is brought into contact, at one end denoted by numeral 85, with switch terminal 68. Switch terminal 68 is coupled to an input of timekeeping circuit IC 42, so that each time correction switch spring 83 is actuated, a correction signal pulse is input to timekeeping circuit IC 42. As a result, successive actuations of the member 81 cause the time information displayed by time indicating hands of the timepiece to be modified to a desired value.

Figure 7A:
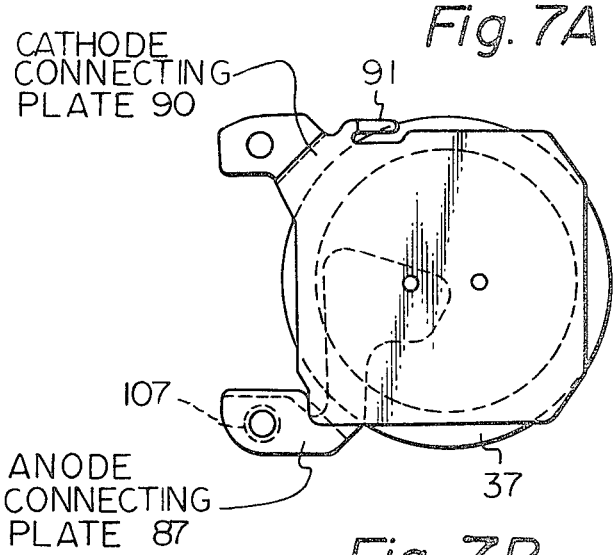
FIGS. 7A, 7B and 7C are diagrams illustrating the external construction of a battery provided with integral connecting members, for use with the movement structure according to the present invention shown in FIG. 3.
Figure 7B:
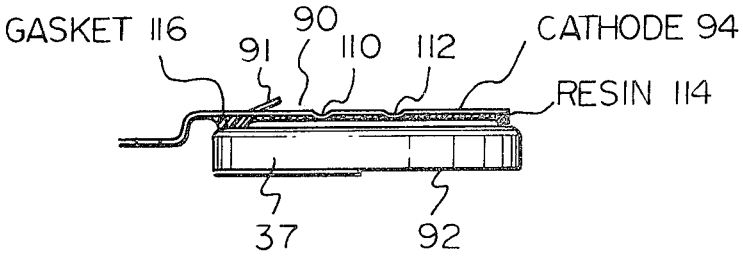
Figure 7C:
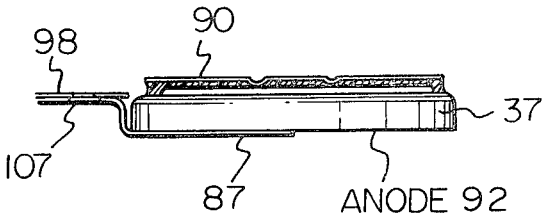

FIGS. 7A, 7B and 7C are plan and elevation views illustrating the configuration of battery 37. Numeral 87 denotes an anode connecting plate which is fixedly attached to the anode 92 of battery 37, e.g. by welding to the anode 92, while numeral 90 denotes a cathode connecting plate which is attached to the cathode 94 of battery 37. The anode and cathode connecting plates 87 and 90 serve to provide electrical connection to battery 37. As shown in FIGS. 7B and 7C, depressions 110 and 112 are formed in cathode connecting plate 90, at which plate 90 is spot-welded to battery 37. The remaining space between the upper surface of battery 37 and the cathode connecting plate 90 is filled with a synthetic resin material 114, which also covers the gasket 116 of battery 37 and hence serves to prevent leakage of the contents of battery 37. A portion 91 of cathode connecting plate 90 is bent upward, as shown in FIG. 7B, to provide contact between the timepiece case and cathode 94. As illustrated in FIG. 7C, part of anode connecting plate 87 extends outward from battery 37 and is bent at right angles, twice, such that a portion 107 is formed parallel to the plane of baseplate 28. A plate of insulating material 98 is fixed to the upper surface of this portion 107 of anode connecting plate 87. As shown in FIG. 7A, holes are provided in the outwardly extending portions of each of the anode and cathode connecting plates 87 and 90. Battery 37 is held in position by battery carrier 96, which is formed from a synthetic resin and is held in place by means of two integrally formed projections 100 and 102 as illustrated in FIG. 6. Projection 100 engages with a cut-out portion of baseplate 28, while projection 102 engages with a cut-out portion of wheel train bridge 56.

Information designating the type of battery and the polarity are marked on the lower surface of anode connecting plate 87, while information relating to the timepiece type, etc, is marked on the upper surface of cathode connecting plate 90. As can be seen in FIG. 5, insulating plate 108 serves to prevent unwanted electrical contact between anode connecting plate 87 and metallic portions of the movement structure.

It should be noted that in the present embodiment, circuit substrate 70 is electrically connected to the cathode of battery 37. It should also be noted that the cathode connecting plate 90 substantially covers the upper surface, i.e. the cathode side, of battery 37.

Figure 8A:
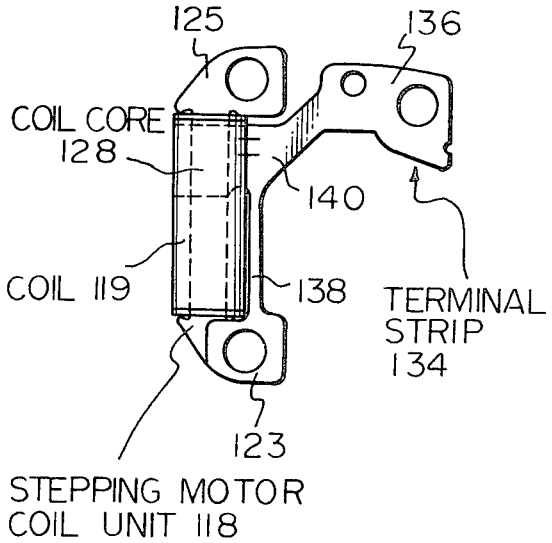
FIGS. 8A, 8B and 8C are diagrams illustrating the configuration of components of a stepping motor used in the movement structure embodiment of FIG. 3.
Figure 8B:
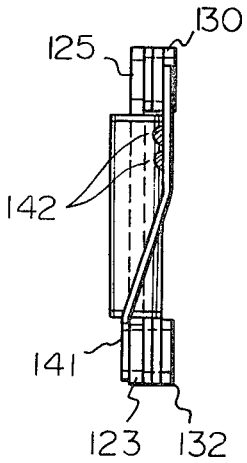
Figure 8C:
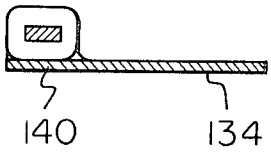

Stepping motor 38 comprises a coil unit 118 which is vertically stacked above a stator 120 and a rotor 122. Stator 120 has two arms, which surround the rotor 122. A permanent magnet 128 is fixedly attached to rotor 122, baseplate 28 and a supporting plate 121, which is welded to stator 120, with rotor 122 being rotatably supported between supporting plate 121 and baseplate 28. The configuration of the coil unit 118 can be understood from FIGS. 7A, 7B and 7C. As shown, the stepping motor coil core 128 has two portions 123 and 125, serving as attachment arms which extend outward from each end of stepping motor coil 119, each of these core end portions 123 and 125 being attached to one or more spacer plates, formed of a highly permeable magnetic material, and denoted by numerals 130 and 132. In this embodiment, three of these spacers are provided for each end of the stepping motor coil core 128. The spacers can be welded or soldered to core 128, and serve to provide magnetic coupling between the coil core 128 and stepping motor stator 126. Numeral 134 denotes a terminal strip for providing electrical connections to the terminals of stepping motor coil 119. The terminal strip 134 has a portion 140 which is attached to the lower surface of stepping motor coil 119, while another portion 141 of terminal strip 134 is attached to the upper surface of an end portion of stepping motor coil core 128, as shown in FIG. 8B. Terminal strip 134 is bent into a shape such that the portion 141 is situated adjacent to the upper surface of stepping motor 118, while the lower portion 140 of terminal strip 134 is positioned below the lower surface of coil 118. In addition, terminal strip 134 is shaped as shown in the plan view of FIG. 8A, such as to leave a space in which battery 37 can be accommodated adjacent to stepping motor coil 119. A conductive pattern, comprising at least three separate conductive paths, is provided on terminal strip 134. Two of these conductive paths serve to provide electrical connections between the terminals of stepping motor coil 119 (as indicated by numeral 142), while another conductive path serves to form part of an electrical circuit between the anode 86 of battery 37 and timekeeping circuit IC 42. These conductive patterns on terminal strip 134 are placed in electrical contact with corresponding patterns formed on a surface of circuit substrate 70, by the corresponding surfaces of terminal strip 134 and circuit substrate 70 being held pressed together. A hole 137 is provided in an arm 136 of terminal strip 134, which serves to engage a setting rivet 84 of time correction switch mechanism 34. This setting rivet 84 serves to prevent terminal strip 134 from moving when the strip is being fixed in place by screw 75 which engages in threaded tube 74 provided in baseplate 28. As can be seen from the cross-sectional view of FIG. 5, stator 120 and stepping motor coil core 128 are magnetically coupled through spacers 130 and 132, by means of attachment screws 150 and 148, which are engaged in threaded tubes 154 and 152 respectively, provided in baseplate 28. Screw 148 serves to clamp in place the insulation sheet 108, anode connecting plate 87, stepping motor arm member 123, spacers 132, and stator 120, vertically stacked in that order on baseplate 28. A conductive track on terminal strip 134 is thereby pressed into electrical contact with anode connecting plate 87. Screw 150 serves to clamp anode connecting plate 90 in place, over stepping motor attachment arm 125, and to thereby press cathode connecting plate 90 into electrical contact with stepping motor coil core 128, thereby effectively connecting the cathode of battery 37 to baseplate 28, so that baseplate 28 is connected to the negative potential of battery 37. L-shaped cut-out portions are provided in battery carrier 96, as denoted by numerals 103 and 105 in FIG. 3, which serve to provide a small space between battery carrier 96 and end portions 143 and 145 of stepping motor coil core 128. As can be seen with reference to FIG. 3 and FIG. 5, the position of coupling portion 62 of wheel train bridge 56 is such that the head of screw is positioned immediately below the portion of terminal strip 134 which is attached to the lower surface of stepping motor coil 119, thereby ensuring that the lower surface of stepping motor coil 119 can be positioned substantially in the same plane as the top surface of wheel train bridge 56. In addition, a stepped portion 64 shown in FIG. 3 is provided in wheel train bridge 56, which enables area 136 of terminal strip 134 to be disposed below the head of screw 75, so that terminal strip 134 is attached in place by screw 75 which passes through a hole provided in terminal strip 134.

The arrangement described above enables the stepping motor coil 119 and battery 37, which are of almost identical thickness as measured in a direction perpendicular to baseplate 28, to be positioned at almost identical heights above baseplate 28, while also allowing wheel train 30 to be accommodated in a space which is formed between the upper surface of baseplate 28 and the lower surface of wheel train bridge 56.

The coupling path of the magnet flux of stepping motor 38 passes from stepping motor coil core 128 through spacers 130 and 132 to the stator 120, whereby a force is applied to permanent magnet 128 attached to stepping motor rotor 122, each time a timekeeping signal pulse is applied to stepping motor coil 119. In this way, the rotor of stepping motor rotor 122 is periodically rotated by the timekeeping signals generated by timekeeping circuit IC 42, and this motion is transmitted through wheel train 30 to the time indicating hands of the timepiece.

As stated above, a movement structure according to the present invention is basically symmetrical about a major axis and a minor axis, is basically of thin, planar shape, and very small size. If the major axis is designated as A, the minor axis as B, the width of stepping motor coil 119 (as measured in a direction parallel to the plane of baseplate 28 and perpendicular to the longitudinal axis of stepping motor coil 119) is designated as C, and battery 37 is disk-shaped and has a diameter designated as D, then the following relationships should be satisfied, for a movement structure according to the present invention:

$$A \leqq 1.5(C+D) \text{ and}$$

$$B \leqq 1.3D.$$

Figure 9:
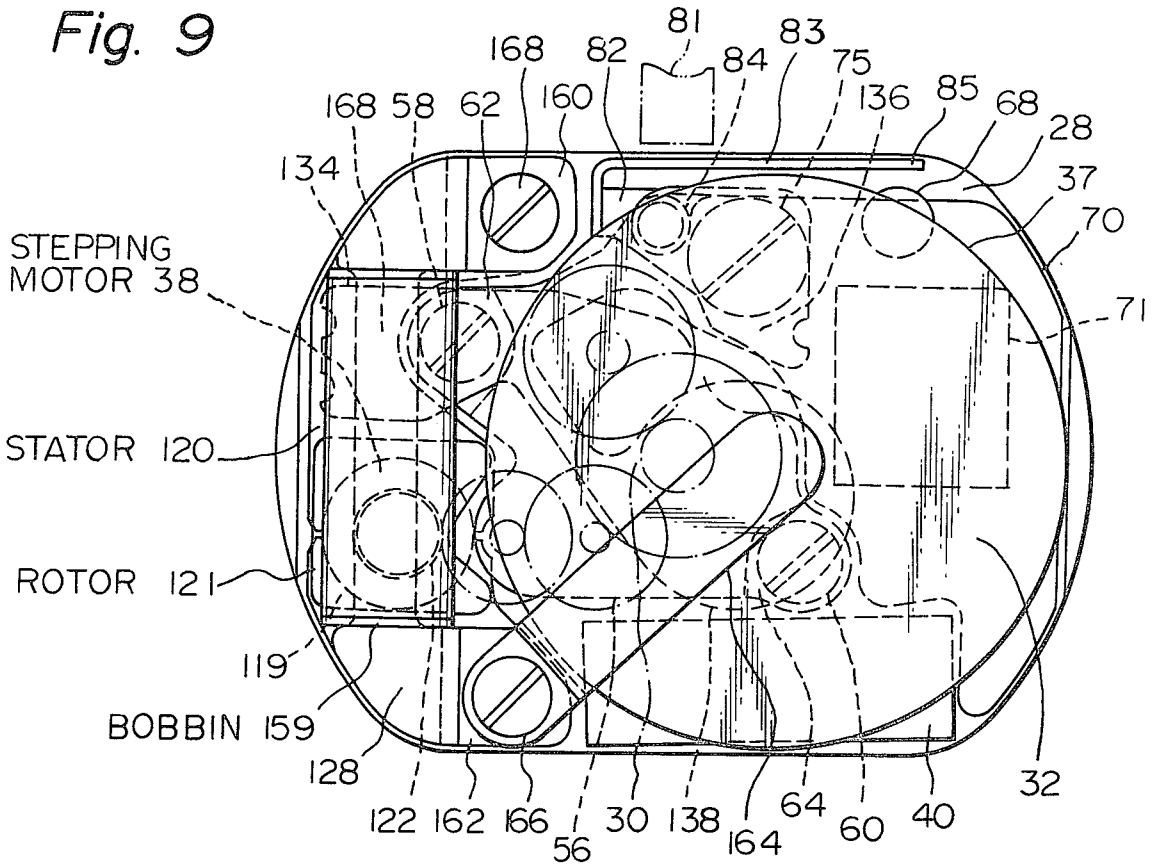
FIG. 9 is a cross-sectional view in plan for illustrating the configuration of a second embodiment of a movement structure for an electronic timepiece according to the present invenion.

Referring now to FIG. 9, a second embodiment of a movement structure according to the present invention is shown. A principal difference between this embodiment and the first embodiment described above lies in the manner in which the magnet flux of stepping motor coil 119 is transferred to the stator of the stepping motor. In the first embodiment this is accomplished by using spacers which are provided at outwardly extending portions of the stepping motor coil core. In the second embodiment, however, this magnetic coupling is provided by making each of the outwardly extending portions of stepping motor core 128 in the form of arms which extend in a direction perpendicular to the longitudinal axis of the core 128, i.e. in a direction parellel to the major axis of the movement structure, and which each are formed with two successive bends at right angles, to thereby provide portions on each of these arms which are located parallel to the plane of baseplate 28 and below plane of the lower surface of the stepping motor coil. This can be understood from the cross-sectional diagram of FIG. 10, in conjunction with the plan view of FIG. 9. The outwardly extending arm portions of stepping motor coil core 128 are designated by numerals 160 and 162. The way in which arm 160 (and arm 162) is bent can be seen in FIG. 10, which also illustrates how arm 160 is pressed into contact with the stepping motor stator 120 by means of a screw 168 which engages in a threaded tube 169 provided in baseplate 28. Arm 162 is clamped to the stator 120 in a similar way, by a screw 166. In this way, the magnetic flux of stepping motor core 128 is transmitted through arms 160 and 162 to stator 120.

Figure 10:
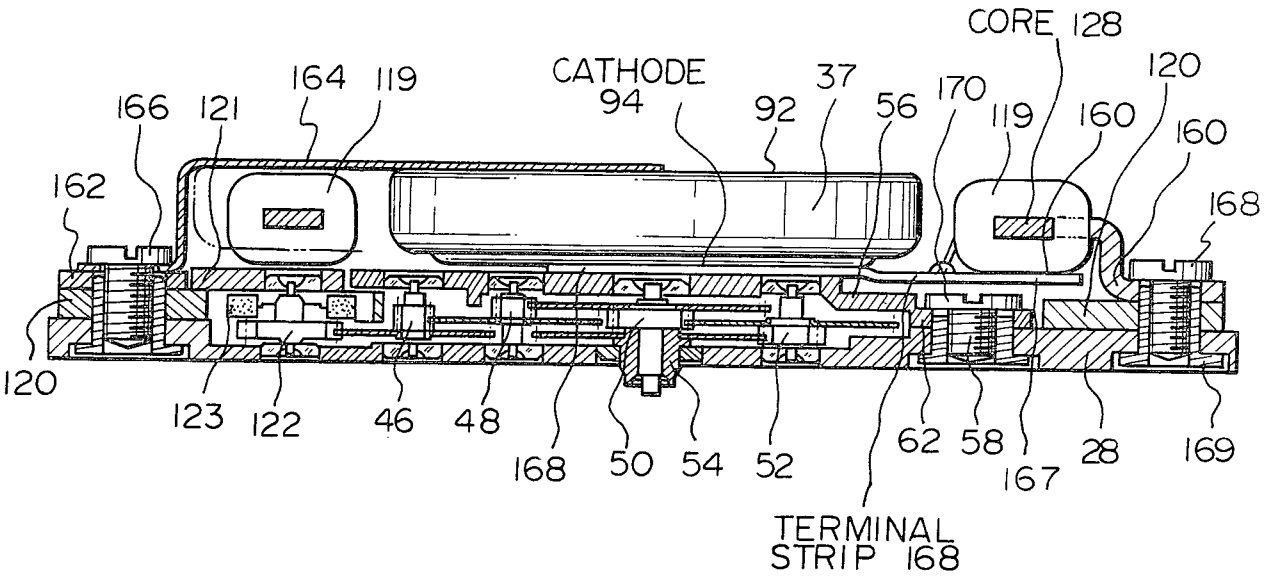
FIG. 10 and FIG. 11 are cross-sectional views in elevation of the second movement structure embodiment of FIG. 9.

Another point of difference between this embodiment and the first embodiment lies in the manner in which electrical contacts are established with the anode and cathode of battery 37. Numeral 164 denotes a battery retaining spring, which is clamped above stepping motor core arm 162 by means of screw 166, and which is bent as illustrated in FIG. 10 in such a way as to contact the anode of battery 37, thereby connecting this anode to baseplate 28 and also acting to retain battery 37 in place.

The configuration of the terminal strip, here denoted by numeral 168, also differs from that of the first embodiment described above. The terminal strip 168 is attached by a portion 167 thereof to the lower surface of stepping motor coil 119, and is provided with two arms 136 and 138. A conductive pattern is provided on terminal strip 168 to provide electrical connections to the terminals of stepping motor coil 119, as denoted by numeral 172 in FIG. 11. Arm 136 is fixed in place by screw 75, which engages with threaded tube 74 provided in baseplate 28. The conductive pattern of terminal strip 168 comprises three conductive tracks, which are placed in electrical contact with corresponding conductive tracks of circuit substrate 70 due to the fact that circuit substrate 70 and terminal strip 168 are held pressed together, i.e. arm portion 136 of terminal strip 168 is clamped against the upper surface of circuit substrate 70 by means of screw 75. Arm 138, on the other hand, passes beneath the central region of the cathode of battery 37, so that a conductive track on arm 138 of terminal strip 168 provides electrical connection between the cathode of battery 37 and a conductive track on circuit substrate 70. Arm 138 covers a major portion of wheel train bridge 56. The lower surface of arm 138 of terminal strip 168 is covered by a layer of polymide insulation, thereby preventing contact between the cathode of battery 37 and wheel train bridge 56. Use of such a polymide insulating layer eliminates the need for an insulating plate between cathode 94 of battery 37 and wheel train bridge 56.

Figure 11:
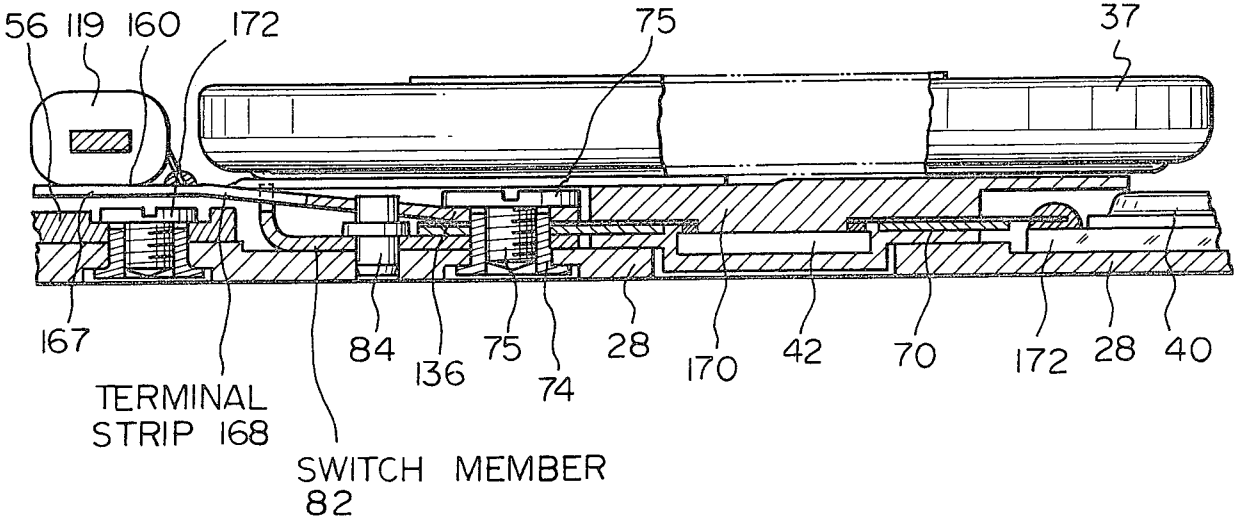

The position of portion 167 of terminal strip 168, attached to the lower surface of stepping motor 119, is arranged to be at approximately the same height above baseplate 28 as the supporting plate 121, which is welded to stator 120 of stepping motor 38, but such that these do not overlap in a horizontal plane. The length of a portion of each of arms 160 and 162 of stepping motor coil core 128 which is perpendicular to the plane of baseplate 28 is such that supporting plate 121 and also portion 167 of terminal strip 168 can be accommodated below the lower surface of stepping motor coil 119, as can be seen from FIG. 5. As in the first embodiment, battery 37 and stepping motor coil 119 are of substantially the same thickness and are arranged at substantially the same height above baseplate 28. The stepping motor coil 119 is formed on a bobbin 159, which is made of laminated polymide resin, having a layer of copper on each end face for increased strength. The timekeeping circuit IC 42 is attached to circuit substrate 70 as shown in FIG. 11, and is covered by a sealing layer of synthetic resin 170. Battery 37 is partially supported on a portion of the upper surface of resin layer 170. As in the first embodiment, quartz crystal vibrator 40 and time correction switch mechanism 34 are arranged with their longitudinal axes substantially aligned with the major axis of the movement structure and on opposite sides of wheel train 30, while stepping motor 38 and timekeeping circuit IC 42 are arranged at opposite ends of baseplate 28, and battery 37 substantially covers the timekeeping circuit IC 42, wheel train 30, and quartz crystal vibrator 40.

It is an essential feature of the second embodiment of the present invention described above that two arms are provided extending from and integral with the coil core of stepping motor 38, which are bent such that a portion of each arm extends in a direction toward battery 37 and is positioned parallel to the plane of baseplate 28 and below the plane of the lower surface of stepping motor coil 119.

Figure 12:
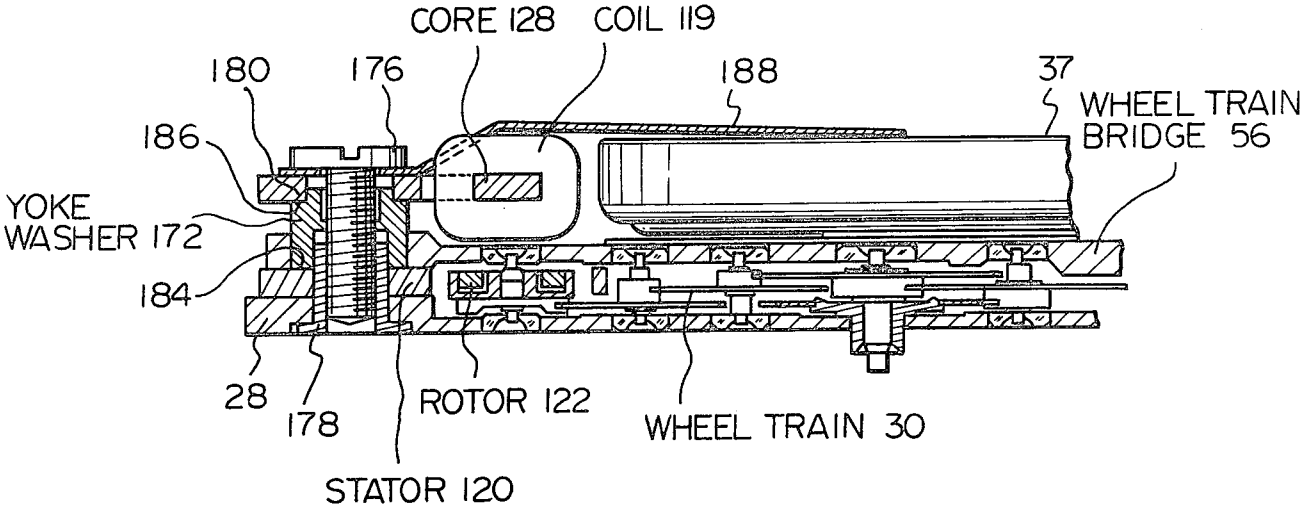
FIG. 12 is a partial cross-sectional view in elevation of a portion of a third embodiment of a movement structure for an electronic timepiece according to the present invention.

Referring now to FIG. 12, a third embodiment of a movement structure according to the present invention will be described. Since the configuration of the third embodiment can be similar to that of the second embodiment described above, in most respects, only a partial view of a movement structure is shown in cross-sectional view in elevation, in FIG. 12, to illustrate the important points of difference between the third embodiment and the second embodiment. One basic difference between the third embodiment and the first two embodiments lies in the manner in which the coil core 128 of stepping motor 38 is magnetically coupled to the stator 120. In the third embodiment, this magnetic coupling is achieved by means of a yoke washer 172, which is formed of a highly permeable magnetic material. The core 128 of stepping motor 38 is provided with two outwardly extending end portions 180, but which are not bent as in the case of the second embodiment. Each of these end portions 180 is clamped such as is shown in FIG. 12, with a lower surface thereof engaged with an upper surface of a yoke washer 172 as indicated by numeral 186. The lower surface of yoke washer 172 is clamped against the upper surface of stator 120, as denoted by numeral 184. Numeral 188 denotes a battery retaining spring, which serves to hold battery 37 in place and to provide electrical contact thereto. Battery retaining spring 188, stepping motor core end portion 180, yoke washer 172, and stator 120 are stacked vertically, in that order, above the upper surface of baseplate 28, and are clamped in position by a screw 176 which engages with a threaded tube 178 provided in baseplate 28. The other components of the movement structure of the third embodiment will not be described herein, as they may be arranged in a similar manner to the second embodiment described above, with the exception of the mounting of stepping motor rotor 122. In the first and second embodiments, rotor 122 is mounted between a supporting plate 121 and the baseplate 28, with the supporting plate 121 being a separate component which is welded or otherwise attached to stator 120 of baseplate 28. However in the third embodiment, as shown in FIG. 12, rotor 122 is rotatably supported between wheel train bridge 56 and baseplate 28, in a similar manner to the gearwheels of wheel train 30.

From the above description of the preferred embodiments, it can be understood that a movement structure according to the present invention for an miniature electronic timepiece can be made of extremely small size and of flat, thin shape. This is achieved by reducing the surface area occupied by the stepping motor of the timepiece, by adopting a configuration for the stepping motor such that the motor coil is positioned directly over the stator and rotor of the stepping motor, by disposing the battery of the timepiece such as to substantially cover the wheel train, crystal vibrator and timekeeping integrated circuit, and by positioning the wheel train in a more or less central portion of the baseplate surface area while disposing the stepping motor, timekeeping circuit IC, quartz crystal vibrator and time correction switch mechanism in areas of the baseplate surrounding the wheel train. In addition, the thickness of the stepping motor coil is arranged to be almost identical to that of the battery, and the coil and battery arranged at substantially the same height above the baseplate.

A miniature quartz crystal type of electronic timepiece incorporating a movement structure according to the present invention can be of sufficiently small size as to be utilizable as part of a ladies costume jewelry, for example as part of a bracelet, a ring, a pendant, etc. However, in spite of the extremely small size, the construction of a movement structure according to the present invention is such that it is not necessary to reduce the size of the timepiece battery considerably, by comparison with conventional quartz crystal electronic timepieces. Thus, a practicable level of battery lifetime can be provided by an electronic timepiece having a movement structure according to the present invention. In addition, the mechanical configuration of a movement structure according to the present invention is basically simple, as can be understood from the preferred embodiments, so that manufacture of such movement structures is highly practicable, from an economic viewpoint.

From the preceding description, it will be apparent that the objevtives set forth for the present invention are effectively attained. Since various changes and modifications to the above construction may be made without departing from the spirit and scope of the present invention, it is intended that all matter contained in the above description or shown in the accompanying drawings shall be interpreted as illustrative, and not in a limiting sense. The appended claims are intended to cover all of the generic and specific features of the invention described herein.

What is claimed is:

1. A movement structure for a miniature analog type of electronic timepiece powered by a battery and having time indicating hands, a crystal vibrator, an electronic circuit electrically coupled to said crystal vibrator for producing timekeeping signals, a time correction switch mechanism which is externally actuatable for producing correction signals to be applied to said electronic circuit unit to provide time correction signals, a stepping motor comprising a coil, a coil core, a stator and a rotor, said stepping motor being responsive to said timekeeping signals for periodically rotating said rotor and also responsive to said time correction signals to correct time indicated by said hands, and a wheel train coupled to said rotor for transmitting the motion thereof, said movement structure comprising:

a baseplate having a central area and first, second, third and fourth areas surrounding said central area; and a wheel train bridge positioned over said central area of the baseplate and secured to said baseplate, such as to provide a space between said wheel train bridge and said baseplate, with said wheel train being contained within said space;

said time correction switch mechanism being positioned in the first area of said baseplate, said electronic circuit unit being positioned in the second area of said baseplate, said crystal vibrator being positioned in the third area of sid baseplate, and said stepping motor being positioned in the fourth area of said baseplate, with said battery being positioned such as to substantially cover said wheel train, said electronic circuit and said crystal vibrator, and with said stepping motor coil being positioned directly above said stepping motor rotor and stator.

2. A movement structure for an electronic timepiece as claimed in claim 1, wherein said movement structure is symmetrical about a major axis and about a minor axis, as viewed in plan, said major axis being of greater length than said minor axis, and wherein said battery is disposed toward one end of said movement structure, with respect to said major axis and wherein said stepping motor is disposed toward the opposite end of said movement structure with respect to said major axis, and further wherein a longitudinal axis of said stepping motor coil is arranged in a direction parallel to said minor axis.

3. A movement structure for an electronic timepiece as claimed in claim 2, wherein said time correction switch mechanism includes a switch member of substantially elongated shape, and wherein said switch member is arranged such as to be longitudinally aligned substantially with said major axis and is positioned adjacent to a side of said movement structure which is parallel to said major axis, between said side and said wheel train.

4. A movement structure for a miniature analog type of electronic timepiece powered by a battery and having time indication hands, a crystal vibrator, a timekeeping circuit electrically coupled to said crystal vibrator for producing timekeeping signals, time correction means which are externally actuatable for correcting time displayed by said hands, a stepping motor comprising coil, a stator and a rotor, said stepping motor being responsive to said timekeeping signals for periodically rotating said rotor, and a wheel train coupled to said rotor for transmitting the motion thereof, said movement structure comprising:

a baseplate having a central area and first, second and third areas surrounding said central area, and;

a wheel train bridge positioned over said central area of said baseplate and fixedly secured thereto such as to provide a space between said baseplate and said wheel train bridge, with said wheel train being contained within said space;

said timekeeping circuit unit being positioned in the first area of said baseplate, said crystal vibrator being positioned in the second area of said baseplate and said stepping motor being positioned in said third area of said baseplate, said wheel train, said timekeeping circuit unit and said crystal vibrator being situated on said baseplate such as to be substantially covered by said battery, said stepping motor coil being positioned in the same plane as said battery and said rotor being mounted in said baseplate in a position directly beneath and immediately adjacent to said stepping motor coil.

5. A movement structure for an electronic timepiece as claimed in claim 4, wherein said movement structure is substantially flat in shape and is substantially symmetrical about a major axis and about a minor axis, as viewed in plan, and wherein said battery is positioned toward one end of said movement structure with respect to said major axis and said stepping motor is positioned toward the opposite end of said movement structure, with the longitudinal axis of said stepping motor coil being aligned perpendicular to said major axis.

6. A movement structure for an electronic timepiece as claimed in claim 5, wherein a portion of said stepping motor coil core extends outward from each of said core, and wherein each of said outwardly extending core portions is bent into a predetermined shape to facilitate attachment of said core portions to said stepping motor for thereby providing magnetic coupling between said stepping motor coil core and said stepping motor stator.

7. A movement structure for an electronic timepiece as claimed in claim 6, wherein each of said outwardly extending end portions of said stepping motor coil core is in the form of an elongated arm, shaped such as to have a first bend directed perpendicular to the plane of said baseplate and toward said baseplate, and a second bend directed parallel to said baseplate, with a part of each of said arms extending in a direction parallel to said major axis toward said battery.

8. A movement structure for an electronic timepiece as claimed in claim 5, wherein said crystal vibrator is of elongated shape, and in which the longitudinal axis of said crystal vibrator is aligned parallel to said major axis.

9. A movement structure for an electronic timepiece as claimed in claim 4, wherein said stepping motor coil and said battery are of substantially equal thickness as measured in a direction perpendicular to said baseplate, and wherein said stepping motor coil and said battery are positioned at substantially equal heights above said baseplate.

10. A movement structure for an electronic timepiece as claimed in claim 4, wherein the rotor of said stepping motor is rotatably mounted within said space between said wheel train and said baseplate.

11. A movement structure for an electronic timepiece as claimed in claim 10, wherein said battery and said stepping motor coil are each positioned above and immediately adjacent to said wheel train bridge.

12. A movement structure for an electronic timepiece as claimed in claim 4, and further comprising a terminal strip for providing electrical connection to said stepping motor coil, with a first portion of said terminal strip being fixedly attached to a portion of said stepping motor coil and with a second portion of said terminal strip being fixedly attached to a portion of said stepping motor coil core.

13. A movement structure for an electronic timepiece as claimed in claim 12, wherein said terminal strip is provided with a conductive pattern, and wherein a portion of said conductive pattern forms at least a part of a circuit path between said battery and said timekeeping circuit block.

14. A movement structure for an electronic timepiece as claimed in claim 5, wherein if the major axis of said movement structure is designated as a, said minor axis is designated as b, the width of said stepping motor coil is designated as c and wherein if said battery is in the shape of a disk having a diameter designated as d, then the relationship $a \leqq 1.5(c+d)$ and the relationship $b \leqq 1.3d$ are satisfied.

15. A movement structure for an electronic timepiece as claimed in claim 4, wherein said battery has an anode connecting member for providing electrical connection to the anode thereof and a cathode connecting member for providing electrical connection to the cathode thereof, and wherein said movement structure further comprises first and second stepping motor attachment members serving both to attach said stepping motor coil and core to said baseplate and to attach said anode connecting member and said cathode connecting member to said baseplate.

16. A movement structure for an electronic timepiece as claimed in claim 15, and further comprising a connecting strip attached to said stepping motor coil for providing electrical connection thereto, and wherein an electrically conductive pattern is formed on said terminal strip, with a portion of said conductive pattern serving to electrically connect at least one of said anode and cathode connecting members to said timekeeping circuit block.

17. A movement structure for an electronic timepiece as claimed in claim 5, and further comprising a battery supporting member formed of a synthetic resin material for supporting said battery in a predetermined position with espect to said major axis of said movement structure.

18. A movement structure for an electronic timepiece as claimed in claim 4, wherein said timekeeping circuit unit comprises an integrated circuit chip covered with a layer of protective material.

19. A movement structure for an electronic timepiece as claimed in claim 4, wherein said stepping motor coil core is provided with integrally formed end portions extending outward from said coil, and further comprising at least one spacer member formed of a magnetically permeable material fixedly attached to each of said end portions, positioned between said end portion and said stator for thereby magnetically coupling said core and said stator and for determining the spacing between said end portions and said stator, as measured in a direction perpendicular to said baseplate.

20. A movement structure for an electronic timepiece as claimed in claim 4, wherein said stepping motor coil core is provided with integrally formed end portions extending outward from said coil, and further comprising a yoke washer formed of a magnetically permeable material positioned between each of said end portions and said stator, for thereby magnetically coupling said core and said stator and for determining the spacing between said end portions and said stator, as measured in a direction perpendicular to said baseplate.

* * * * *